US007537637B2

(12) United States Patent
Jutterström et al.

(10) Patent No.: US 7,537,637 B2
(45) Date of Patent: May 26, 2009

(54) METHOD OF MAKING AGGLOMERATED CEMENTED CARBIDE POWDER MIXTURES

(75) Inventors: Ulf Jutterström, Stockholm (SE); Annika Kauppi, Hässelby (SE)

(73) Assignee: Sandvik Intellectual Property AB, Sandviken (SE)

( * ) Notice: Subject to any disclaimer, the term of this patent is extended or adjusted under 35 U.S.C. 154(b) by 300 days.

(21) Appl. No.: 11/434,514

(22) Filed: May 16, 2006

(65) Prior Publication Data

US 2006/0272451 A1 Dec. 7, 2006

(30) Foreign Application Priority Data

May 17, 2005 (SE) ..... 0501103

(51) Int. Cl.
*B22F 9/04* (2006.01)

(52) U.S. Cl. ..... 75/352; 419/66

(58) Field of Classification Search ..... None
See application file for complete search history.

(56) References Cited

U.S. PATENT DOCUMENTS 4,397,889 A * 8/1983 Benjamin et al. ..... 427/221
6,245,288 B1 6/2001 Carroll
6,352,571 B1 3/2002 Waldenström et al.
6,656,976 B2 * 12/2003 Bergstrom et al. ..... 516/88
7,094,821 B2 * 8/2006 Kruse et al. ..... 524/322

FOREIGN PATENT DOCUMENTS

| | | |
|---|---|---|
| EP | 0819777 B1 | 10/2001 |
| EP | 1440956 A1 | 7/2004 |
| WO | 98/00256 | 1/1998 |
| WO | 98/18973 | 5/1998 |

* cited by examiner

*Primary Examiner*—George Wyszomierski
(74) *Attorney, Agent, or Firm*—Drinker Biddle & Reath LLP

(57) ABSTRACT

The present invention relates to a method of making an agglomerated powder mixture by wet milling a powder mixture containing hard constituent powder(s) based on carbides of Ti, Zr, Hf, V, Nb, Ta, Cr, Mo and/or W and greater than about 15 wt-% binder phase powder(s) of Co and/or Ni as well as pressing agents and spray drying said slurry. By adding to said powder mixture before milling in addition from about 0.05 to about 0.50 wt-% of a complex forming and/or pH-decreasing/increasing additive such as triethanolamine, hydroxides or acids and a thickener in an amount of from about 0.01 to about 0.10 wt-% agglomerates with excellent flow properties are obtained.

6 Claims, 1 Drawing Sheet

METHOD OF MAKING AGGLOMERATED CEMENTED CARBIDE POWDER MIXTURES

BACKGROUND OF THE INVENTION

The present invention relates to a method of making agglomerated cemented carbide powder mixtures with high binder phase content.

Cemented carbide alloys are made of hard constituents based on carbides in a binder phase essentially based on Co and/or Ni. A binder phase content of from about 5 to about 15 wt-% is generally found in tools for metal machining and rock drilling and many wear parts. A low binder phase content results in an alloy with high wear resistance and low toughness whereas a high binder phase content gives an alloy with higher toughness and lower wear resistance. In applications demanding extremely high wear resistance, a binder phase content of less than about 5 wt-% can be used. Components with such low binder phase content have to be mounted under prestressed conditions. Examples of are seal rings where a further advantage of the low binder phase content is the increased corrosion resistance. On the other hand in applications where high toughness is indispensable yet good wear resistance is needed, binder phase contents of from about 20 to about 30 wt-% are used. A typical example is rolls for hot rolling. A further advantage of the high binder phase content in such rolls is that they can easily be reground when worn.

Cemented carbide bodies are made by powder metallurgical methods comprising wet milling a powder mixture containing powders forming the hard constituents and binder phase as well as pressing agents and other additives often of proprietary character, drying the milled mixture to a powder with good flow properties, pressing the dried powder to bodies of desired shape and finally sintering.

The intensive milling operation is performed in mills of different sizes using cemented carbide milling bodies. Milling is considered necessary in order to obtain a uniform distribution of the binder phase in the milled mixture. The milling time is in the order of several hours up to days. The milling operation produces a slurry which is suitable for subsequent spray drying. Successful spray drying depends strongly on the slurry properties. The viscosity of the slurry has to be optimised, shear thickening has to be avoided and sedimentation has to be minimised. Sedimentation will result in inferior properties of spraydried powders and may cause severe flowability problems. The current technology of intensive milling during extended period of times usually produces a very fine grained powder suspension in which little or no sedimentation takes place. As a result of the spray drying process spherical agglomerates of about 0.1 mm diameter are obtained held together by the pressing agent. This is true for cemented carbide compositions with a medium to low binder phase content. However, for binder phase contents of from about 20 to about 30 wt-% for some at present unknown reason the agglomerates formed have inferior properties which results in a ready to press powder with very bad flow properties not useful for automated production. Instead more manual methods have to be applied in order to ensure a satisfactory sintered product.

OBJECTS AND SUMMARY OF THE INVENTION

It is an object of the present invention to provide an improved method for the manufacture of cemented carbide compositions with high binder phase content.

It is a further object of the present invention to provide a ready to press cemented carbide powder with high binder phase content consisting essentially of spherical agglomerates of narrow size distribution.

In one aspect of the present invention, there is provided a method of making an agglomerated power mixture by wet milling a powder mixture containing hard constituent powder (s) based on carbides of Ti, Zr, Hf, V, Nb, Ta, Cr, Mo and/or W and greater than about 15 wt-% binder phase powder(s) of Co and/or Ni as well as pressing agents and spray drying said slurry, comprising adding to said powder mixture before milling additionally from about 0.05 to about 0.50 wt-% of a complex forming and/or pH-decreasing/increasing additive and a thickener in an amount of from about 0.01 to about 0.10 wt-%.

In another aspect of the invention, there is provided a slurry containing hard constituent powder(s) based on carbides of Ti, Zr, Hf, V, Nb, Ta, Cr, Mo and/or or W and greater than about 15 wt-% binder phase powder(s) of Co and/or Ni, pressing agents, from about 0.05 to about 0.50 wt-% of a complex forming and/or pH-decreasing/increasing additive and a thickener in the amount of from about 0.01 to about 0.10 wt-%.

In still a further aspect of the invention, there is provided an agglomerated powder containing hard constituent powder(s) based on carbines of Ti, Zr, Hf, V, Nb, Ta, Cr, Mo and/or W and greater than about 15 wt-% binder phase powder(s) of Co and/or Ni as well as pressing agents having an agglomerate size distribution with a span, $S=d97/d03<1.2$ where d97=the agglomerate size below which 97% of the agglomerates is found and d03=the agglomerate size below which 3% of the agglomerates is found.

DETAILED DESCRIPTION OF THE PREFERRED EMBODIMENTS

Figure 1:
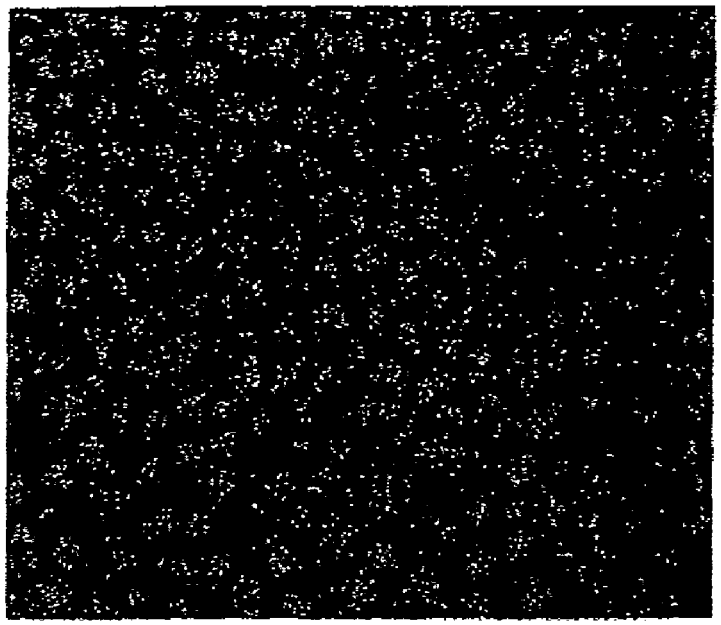
FIG. 1 shows in 50× magnification cemented carbide agglomerates made according to the invention.

It has now surprisingly been found that a spray dried cemented carbide powder with high cobalt content with well developed agglomerates with round shape and a narrow size distribution can be obtained In a first aspect the invention relates to a method of making an agglomerated powder mixture by wet milling, preferably in a milling liquid comprising water and/or alcohol or a mixture of water and acetone, a powder mixture containing hard constituent powder(s) based on carbides of Ti, Zr, Hf, V, Nb, Ta, Cr, Mo and/or W and more than about 15 wt-% binder phase powder(s) of Co and/or Ni as well as pressing agents and spray drying said slurry. According to the invention, to said powder mixture is added before milling additionally from about 0.05 to about 0.50 wt-% of a complex forming and/or pH-decreasing/increasing additive such as triethanolamine, hydroxides or acids, for example, and a thickener in an amount of thickener from about 0.01 to about 0.10 wt-%.

The thickener is a conventional thickener as used in, e.g., paint industry. Suitable thickeners include cross-bonded acrylate emulsions, hydrophobic modified-hydroxyethyl cellulose (HM-HEC), hydrophobic modified-ethyleneoxide-urethane (HEUR), styrene-maleic anhydride copolymers, xanthan polysaccharide and ethylhydroxyethyl cellulose (EHEC), alone or in combination. In one preferred embodiment, the slurry contains from about 20 to about 30 wt-% binder phase powders. In another preferred embodiment the hard constituent is WC.

A second aspect of the invention relates to a slurry containing hard constituent powder(s) based on carbides of Ti, Zr, Hf, V, Nb, Ta, Cr, Mo and/or W and greater than about 15 wt-% binder phase powder(s) of Co and/or Ni as well as pressing agents further containing from about 0.05 to about 0.50 wt-% of a complex forming and/or pH-decreasing/increasing additive such as triethanolamine, hydroxides or acids, for example, and a thickener whereby the amount of said thickener is from about 0.01 to about 0.10 wt-%. The thickener is of the type as set forth above, alone or in combination.

In one preferred embodiment said slurry contains from about 20 to about 30 wt-% binder phase powders. In another preferred embodiment the hard constituent is WC.

In a third aspect the invention relates to an agglomerated powder containing hard constituent powder(s) based on carbides of Ti, Zr, Hf, V, Nb, Ta, Cr, Mo and/or W and greater than 15 wt-% binder phase powder(s) of Co and/or Ni as well as pressing agents with an agglomerate size distribution with a span, S=d97/d03<1.2 where d97=the agglomerate size below which 97% of the agglomerates is found and d03=the agglomerate size below which 3% of the agglomerates is found.

In one preferred embodiment, said powder contains from about 20 to about 30 wt-% binder phase. In another preferred embodiment, the hard constituent is WC.

The invention is additionally illustrated in connection with the following examples, which are to be considered as illustrative of the present invention. It should be understood, however, that the invention is not limited to the specific details of the examples.

EXAMPLE 1

A cemented carbide ready to press powder intended for the manufacture of hot rolls with a binder phase of 15 wt-% Ni, 13 wt-% Co and WC as rest with an average grain size of 18 μm was prepared by milling of the appropriate amounts of Co-, Ni- and WC-powders together with 2 wt-% PEG, 0.125 wt-% Triethanolamine and 0.025 wt-% Bermocoll EBS 451 FQ for 9 hours in an alcohol+water mixture. A slurry with low sedimentation tendency was obtained. The slurry was dried in a spray drier according to standard practice. An agglomerated powder mixture with a narrow size distribution according to FIG. 1 was obtained.

EXAMPLE 2

Figure 2:
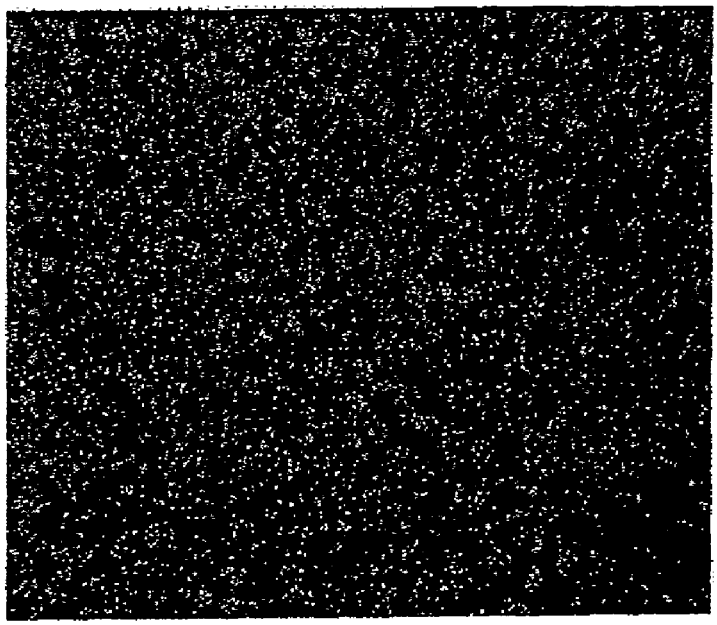
FIG. 2 shows in 50× magnification cemented carbide agglomerates made according to prior art.

Example 1 was repeated but without the addition of triethanolamine and Bermocoll. Even in this case a slurry with low sedimentation tendency was obtained. An 'agglomerated' powder with a wide agglomerate size distribution and in which part of the original powders had not formed agglomerates at all was obtained as shown in FIG. 2.

EXAMPLE 3

The powders from Examples 1 and 2 were subjected to measurements of flow time according to ISO 4490 and apparent density according to ISO 3953 with the following results. The agglomerate size distribution was also determined and was characterized as the span, S=d97/d03 where d97=the agglomerate size below which 97% of the agglomerates is found and d03=the agglomerate size below which 3% of the agglomerates is found.

| | Flow Time, s | Apparent Density g/cm3 | Span |
|---|---|---|---|
| Example 1 | 36 | 3.02 | 1.1 |
| Example 2 | 42 | 2.85 | 1.5 |

Although the present invention has been described in connection with preferred embodiments thereof, it will be appreciated by those skilled in the art that additions, deletions, modifications, and substitutions not specifically described may be made without department from the spirit and scope of the inventions defined in the appended claims.

The invention claimed is:

1. Method of making an agglomerated powder mixture comprising:

forming a slurry by wet milling a powder mixture containing hard constituent powder(s) based on carbides of Ti, Zr, Hf, V, Nb, Ta, Cr, Mo and/or W and greater than about 15 wt-% binder phase powder(s) of Co and/or Ni as well as pressing agents and adding to said powder mixture before milling additionally from about 0.05 to about 0.50 wt-% of triethanolamine and a thickener in an amount of from about 0.01 to about 0.10 wt-%; and drying said slurry to form the agglomerated powder mixture.

2. A method claim 1 wherein said thickener is one or more of cross-bonded acrylate emulsions, hydrophobic modified-hydroxyethyl cellulose (HM-HEC), hydrophobic modified-ethyleneoxide-urethane (HEUR), styrene-maleic anhydride copolymers, xanthan polysaccharide and ethylhydroxyethyl cellulose (EHEC), alone or in combination.

3. A method of claim 1 wherein said powder mixture contains from about 20 to about 30 wt-% binder phase powders.

4. A method of claim 1 wherein said hard constituent comprises WC.

5. A method of claim 1 wherein drying is by spray drying.

6. A method of claim 1 wherein the agglomerated powder mixture has an agglomerate size distribution with a span, S=d97/d03<1.2, where d97=the agglomerate size below which 97% of the agglomerates is found and d03=the agglomerate size below which 3% of the agglomerates is found.

* * * * *